US010219637B2

(12) United States Patent
Åberg et al.

(10) Patent No.: US 10,219,637 B2
(45) Date of Patent: Mar. 5, 2019

(54) FEEDER DEVICE

(71) Applicant: HL DISPLAY AB, Nacka (SE)

(72) Inventors: Isak Åberg, Stockholm (SE); Mårten Sjöberg, Stockholm (SE)

(73) Assignee: HL DISPLAY AB, Nacka (SE)

( * ) Notice: Subject to any disclaimer, the term of this patent is extended or adjusted under 35 U.S.C. 154(b) by 0 days.

(21) Appl. No.: 15/758,482

(22) PCT Filed: Sep. 9, 2016

(86) PCT No.: PCT/EP2016/071294

§ 371 (c)(1),
(2) Date: Mar. 8, 2018

(87) PCT Pub. No.: WO2017/042328

PCT Pub. Date: Mar. 16, 2017

(65) Prior Publication Data

US 2018/0242756 A1 Aug. 30, 2018

(30) Foreign Application Priority Data

Sep. 9, 2015 (EP) ..... 15184443

(51) Int. Cl.
*A47B 1/04* (2006.01)
*A47F 1/12* (2006.01)
(Continued)

(52) U.S. Cl.
CPC ..... *A47F 1/126* (2013.01); *A47F 1/04* (2013.01); *A47F 1/125* (2013.01); *A47F 5/005* (2013.01)

(58) Field of Classification Search
CPC .... A47F 1/04; A47F 1/12; A47F 1/125; A47F 1/126; A47F 5/005
See application file for complete search history.

(56) References Cited

U.S. PATENT DOCUMENTS 3,018,149 A * 1/1962 Parker ..... A47B 81/007 116/303
4,742,936 A 5/1988 Rein
(Continued)

FOREIGN PATENT DOCUMENTS

JP H07241227 A 9/1995
JP 2003210286 A 7/2003
(Continued)

OTHER PUBLICATIONS

International Search Report and Written Opinion for International Application No. PCT/EP2016/071294 dated Nov. 16, 2016, 9 pages.

*Primary Examiner* — Kimberley S Wright
(74) *Attorney, Agent, or Firm* — RMCK Law Group, PLC

(57) ABSTRACT

A feeder device configured for mounting on a shelf for feeding successive products (p) to a front of the shelf. The device comprises an elongated guide member (10) which is configured for extending longitudinally backwards from the front of the shelf when the device is mounted. A sled (30) is slidably arranged at the guide member (10) such that the sled can slide along the length of the elongated guide member, and configured for engaging a backmost product of the successive products (P) for pushing the products towards the front of the shelf. The feeder device also comprises means (35) for urging the sled (30) along the guide member (10) towards a front end of said guide member. Indication means are arranged to indicate that the sled (30) has reached a certain position along the guide member (10). The indication means comprises a transmission member (60) which is longitudinally, limitedly displaceable relative to the guide member (10); and a magnet (37) which is arranged to connect and to disconnect the transmission member (60) with and from the sled (30).

15 Claims, 5 Drawing Sheets

(51) Int. Cl.
*A47F 5/00* (2006.01)
*A47F 1/04* (2006.01)

(56) References Cited

U.S. PATENT DOCUMENTS

| | | | | |
|---|---|---|---|---|
| 5,743,428 | A | 4/1998 | Alexander | |
| 5,992,652 | A * | 11/1999 | Springs | A47F 1/126 211/59.3 |
| 9,486,088 | B2 * | 11/2016 | Hardy | A47F 5/0068 |
| 9,750,354 | B2 * | 9/2017 | Hardy | A47F 1/126 |
| 2009/0039040 | A1 * | 2/2009 | Johnson | A47F 1/126 211/120 |
| 2010/0230369 | A1 | 9/2010 | Weshler | |
| 2011/0218889 | A1 * | 9/2011 | Westberg | G06Q 10/087 705/28 |
| 2015/0320237 | A1 * | 11/2015 | Hardy | A47F 5/0068 211/59.3 |
| 2017/0119175 | A1 * | 5/2017 | Hardy | A47F 1/126 |
| 2018/0070743 | A1 * | 3/2018 | Hardy | A47F 3/14 |

FOREIGN PATENT DOCUMENTS

| | | | |
|---|---|---|---|
| WO | 2012042721 | A1 | 4/2012 |
| WO | 2013153579 | A1 | 10/2013 |

* cited by examiner

FEEDER DEVICE

CROSS-REFERENCE TO RELATED APPLICATIONS

This application is a 371 U.S. National Stage of International Application No. PCT/EP2016/071294, filed Sep. 9, 2016, which claims priority to European Application No. 15184443.8, filed on Sep. 9, 2015. The disclosures of each of the above applications are incorporated herein by reference in their entirety.

TECHNICAL FIELD

The present invention relates a feeder device for mounting on a shelf for feeding successive products to a front of the shelf. Particularly, it relates to such a feeder device comprising means for indicating that the feeder device is running out of products,

BACKGROUND

Stores that retail convenience goods or commodities on a daily basis often present their goods on shelves. In order to create an ordered display of these displayed goods and to enhance their presentation there is used shelf management systems comprising a number of different accessories, such as shelf dividers, different types of feeder devices for pushing the goods and different types of trays, etc. Such accessories are often mounted on the upper surface of the shelf.

Known technology allows these accessories to be affixed to the shelf in a number of different ways, for instance mechanically with the aid of screws or corresponding devices, by frictional engagement or by adhesion with the aid of double-sided adhesive tape or by corresponding means.

The devices used to fasten the accessories to the shelves will preferably have some fundamental properties. One important property resides in the ability to fasten the accessories at selected positions along the length of the shelving, so as to position the accessories in a selected space relationship that is adapted to suit different packages and different quantities of goods.

It is also particularly important that the accessories are securely held to the shelving. The fixing device should, of course, prevent the accessories from being loosened inadvertently from the shelving. It is also important that the accessories will not be displaced inadvertently along the shelving.

For reasons of space and also for aesthetical reasons it is preferable that the accessory fixing arrangement projects as slightly as possible from the upper surface of the shelving and its front side.

Shelf dividers are an example of accessories with which the space relationship of the accessories is particularly important. The shelf dividers often consist of partitioning walls which are fastened to the shelving such as to extend at right angles to the longitudinal direction of the shelving and to project perpendicularly therefrom. The primary purpose of the shelf dividers is to separate different groups of goods from one another and to create order on the shelving. Particularly when a goods pushing means is placed between two shelf dividers, it is essential that the shelf dividers are not displaced towards one another, not even to the slightest extent, since the friction between goods and shelf dividers may then become so great as to prevent advancement of the goods.

Feeder devices for merchandising in general are used for example in grocery stores where goods are exposed on the shelves. Feeder devices are used to push forward placed goods or stored items, one behind the other in rows, to the front edge of the shelf, in order to facilitate the picking of the goods, improve visibility of the goods and make the shelf aesthetic appearance more appealing.

The feeder device may include a base or web which is placed on the shelf so that it extends from the shelf front edge in a rearward direction. A feed sled is slidably disposed on the base along its length. When the shelf is to be refilled, the sled is pushed rearwards and a row of products is placed in front of the sled, which then engages the back side of the rearmost product. At automatic feeder devices the sled is forwardly biased, for example by a coil spring which is arranged on the backside of the sled and which at one end is attached to the front end of the base. At manually operated feeder devices, a tool having a handle or grip which is accessible by a person standing in front of the shelf may be connected to the sled. When the foremost positions at the shelf are empty, personnel may grip the handle and pull the sled forwardly, thereby moving the remaining products forwardly and filling the foremost positions.

To improve the system of the shelves and to separate neighbouring goods from one another, feeder devices are often used together with shelf dividers or partitions. The dividers comprise a dividing wall that extends from the shelf front edge in an essentially rearward direction. Dividers may also comprise a front stop plate or front extending perpendicularly to the dividing wall on one or both sides of said wall, to prevent goods from falling off the shelf. The dividers are attached to the shelf next to each other to form compartments in which the feeder devices are placed. The distance between dividers is chosen in accordance with the relevant goods width, so that the goods are brought into line with each other in their respective compartments. This minimizes the space required to store the goods on the shelf, while the shelf aesthetic appearance becomes more appealing. To fit the different products and product packaging, dividers can be designed in a variety of ways. For example, the dividing wall height may vary widely. Furthermore, the fronts of the dividers can be designed in a variety of ways, for example as regards the width, height and contour, to suit different goods and to provide desired visual impact for every occasion.

Feeder devices and dividers should be easy to assemble and disassemble from the shelf. The feeder devices and the partitions are possible to fix at arbitrary positions laterally along the shelf, to thereby provide goods compartment with the desired width.

Especially at shelf management systems comprising automatic feeders, it may be difficult for personnel working in the store to know how many products are remaining in each compartment and when the compartment should be refilled. Each compartment should preferably be refilled before the compartment is completely empty, since this increases the sales and customer satisfaction. Normally, the compartments should ideally be refilled when approximately three to four products remain in the compartment.

WO 2012/042721 A1, JP 2003210286 A and JP H 07241227 A all disclose feeder devices with means for continuously displaying the number of remaining products. Such continuous display of the number of remaining products is however often superfluous since it is sufficient for the personnel to know only whether or not the number of products has decreased below a certain value. The continuous display also requires a relatively complex design involving a comparatively high number of moving components or electronics. Furthermore, these devices requires that the person wanting to know the number of remaining approaches each feeder device individually and studies the displayed number at a comparatively short distance.

WO 2013/153579 A1 discloses a feeder device which comprises means for detecting and alerting that the remaining number of fed items has fallen below a predetermined number. At this known device the alert is given at the rear end of the device. The device is comparatively complex in construction and the rear end alert requires that the forward movement of the feeder sled is translated into a rearward movement of the alert member.

It would be advantageous if personnel directly could get an indication that products are running out in certain shelf compartments by just walking along the shelf aisle or even just cast a glance along the aisle from its end.

SUMMARY

It is an object of the present invention to provide an enhanced feeder device which gives a low stock indication, indicating that the number of remaining products has decreased below a certain value.

Another object is to provide such a feeder device which gives a binary and criteria triggered low stock indication.

A further object is to provide such a feeder device at which the low stock indication is readily observable at a distance.

Yet another object is to provide such a feeder device which visually gives a clear low stock indication that may be observed at a glance.

A still further object is to provide such a feeder device at which the low stock indication is automatically reset when the feeder device is refilled with products.

Still another object is to provide such a feeder device which is simple in construction and reliable in use.

A further object is to provide such a feeder device which allows to give a low stock indication at a distance, remotely from the shelf.

These and other objects are achieved by feeder device as set out in the preamble of claim 1, which feeder device exhibits the special technical features specified in the characterizing portion of said claim. The feeder device is configured for mounting on a shelf and for feeding successive products to a front of the shelf. The device comprises an elongated guide member which is configured for extending longitudinally backwards from the front of the shelf when the device is mounted. A sled is slidably arranged at the guide member such that the sled can slide along the length of the elongated guide member, and is configured for engaging a back-most product of the successive products for pushing the products towards the front of the shelf. The device further comprises means for urging the sled along the guide member towards a front end of said guide member; and indication means arranged to indicate that the sled has reached a certain position along the guide member. The indication means comprises a transmission member which is longitudinally, limitedly displaceable relative to the guide member; and a magnet which is arranged to connect and to disconnect the transmission member with and from the sled.

The invention thus utilizes a magnet for connecting and disconnecting the sled to and from the transmission member, which is limitedly movable between a passive and an active position, relative to the guide member. By this means, it is readily achieved that the sled may move relative to the guide member without displacing the transmission member when the number of remaining products is above a certain predetermined value. At such instances the transmission member is positioned in a passive non-indicating retraced position and the distance between the sled and the transmission member is greater than the reach of the magnetic force, such that there is no magnetic interaction between the sled and the transmission member. When products are removed by a customer and the sled, during forward movement, reaches a certain position, which corresponds to the predetermined value of remaining products, the transmission member is connected to the sled by a magnetic force interacting between these two components. Thereafter, when a further product is removed, the transmission member follows the sled forwardly to an active indicating forward position. Since the transmission member is only limitedly displaceable, the transmission member is retained in this indicating position also if further products are removed and the sled is moved further forwardly. At such instances, the retaining force which limits forward displacement of the transmission member overcomes the magnetic force and the sled is allowed to move forwardly relative to the transmission member in spite of the magnetic interaction.

The transmission member may comprise or be fixed or connected to a visual indication means which, in the active indicating position of the transmission member, protrudes forwardly from the edge of the shelf. By this means personnel in the store will immediately and simply by casting a glance into the shelf aisle note that the number of remaining products has fallen to the predetermined value and that the feeder device in question should be refilled.

When refilling the feeder device with new products, the sled is first manually pushed rearwardly for making space to the products that are to be inserted. During the initial rearward displacement of the sled, the magnetic interaction between the sled and the transmission member causes the transmission member to follow the sled until the transmission member reaches its rear displacement limit, i.e. its passive retracted position. During continued reward movement of the sled, the movement limiting force overcomes the magnetic force such that the transmission member is retained in the passive retracted position while the sled continues to its rearmost position for allowing insertion of new products. By this means the indication means is automatically reset to the passive mode when the feeder device is refilled with new products.

The feeder device thus allows for a clear and readily observable low stock indication. It is also very easy to operate. The device further requires only a low number of movable parts, is reliable in use and may readily be manufactured at a comparatively low cost.

The indication means may comprise a visual indicator which is arranged at the front end of the guide member.

The visual indicator may be connected or fixed to the transmission member. Alternatively it may form part of the transmission member.

Alternatively or in combination, the indication means may comprise an electronic circuit arranged to give an electronic indication when the sled has reached said certain position along the guide member.

The electronic circuit may be arranged to give the electronic indication at a distance from the shelf.

It is e.g. possible that the transmission member is connected to a switch or a sensor which gives an electronic signal when the sled has reached the predetermined position.

The signal may be conducted or transmitted to a control panel or a computer arranged remotely from the shelf, e.g. in an office or a storage of the store. It is then possible for personnel to be notified that the feeder device needs to be refilled without the need of walking through the store.

One of the sled and the transmission member may comprise a first magnet and the other of the sled and the transmission member may comprise a second magnet or a magnetic material. The second magnet or the magnetic material respectively may then be arranged to be attracted by the first magnet, thereby connecting the transmission member with the sled.

The transmission member may comprise a metal rod.

The transmission member may be guidedly received in a longitudinal groove arranged in the guide member.

The transmission member and the guide member may be provided with cooperating stop means arranged to allow only a limited longitudinal displacement of the transmission member relative to the guide member.

The guide member may exhibit a through hole with a front edge and a rear edge and the transmission member comprises a stop portion extending through the through hole and being arranged to limit forward and rearward displacement of the transmission member by contacting the front edge and rear edge respectively.

The through hole may be arranged in a bottom surface of the longitudinal groove.

The transmission member may be formed of a magnetic metal rod exhibiting a first rectilinear front portion a second intermediate stop portion which extends perpendicularly from the first portion and a third rectilinear rear portion which extends perpendicular from the second portion and in parallel with the first portion.

The first portion may be guidedely received in a longitudinal groove arranged in the guide member, the second portion may extend through a through hole arranged in the guide member and the third portion may be arranged below a bottom wall of the guide member.

The means for urging the sled forwardly may comprise a coil spring with an end portion which is fixed to the front end of the guide member.

The guide member may comprise a shelf divider wall.

Further objects and advantages of the invention will appear from the following detailed description of embodiments and from the appended claims.

BRIEF DESCRIPTION OF THE DRAWINGS

Embodiments will be described, by way of example, with reference to the accompanying drawings, in which.

DETAILED DESCRIPTION

Embodiments will now be described more fully hereinafter and with reference to the accompanying drawings, in which a certain embodiment is shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Figure 1A:
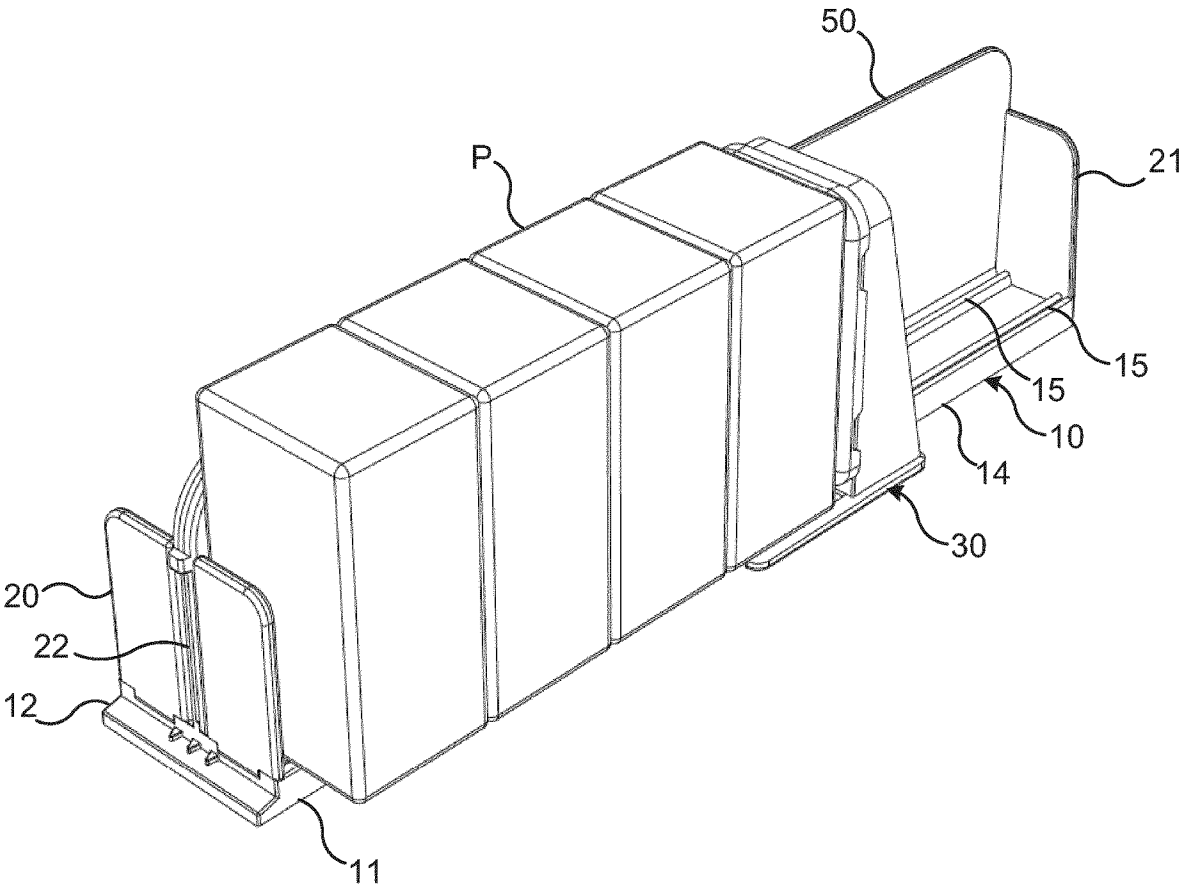
FIG. 1*a* is a perspective view obliquely from the front of a feeder device according to an embodiment of the invention and with a number of products placed in the device.
Figure 1B:
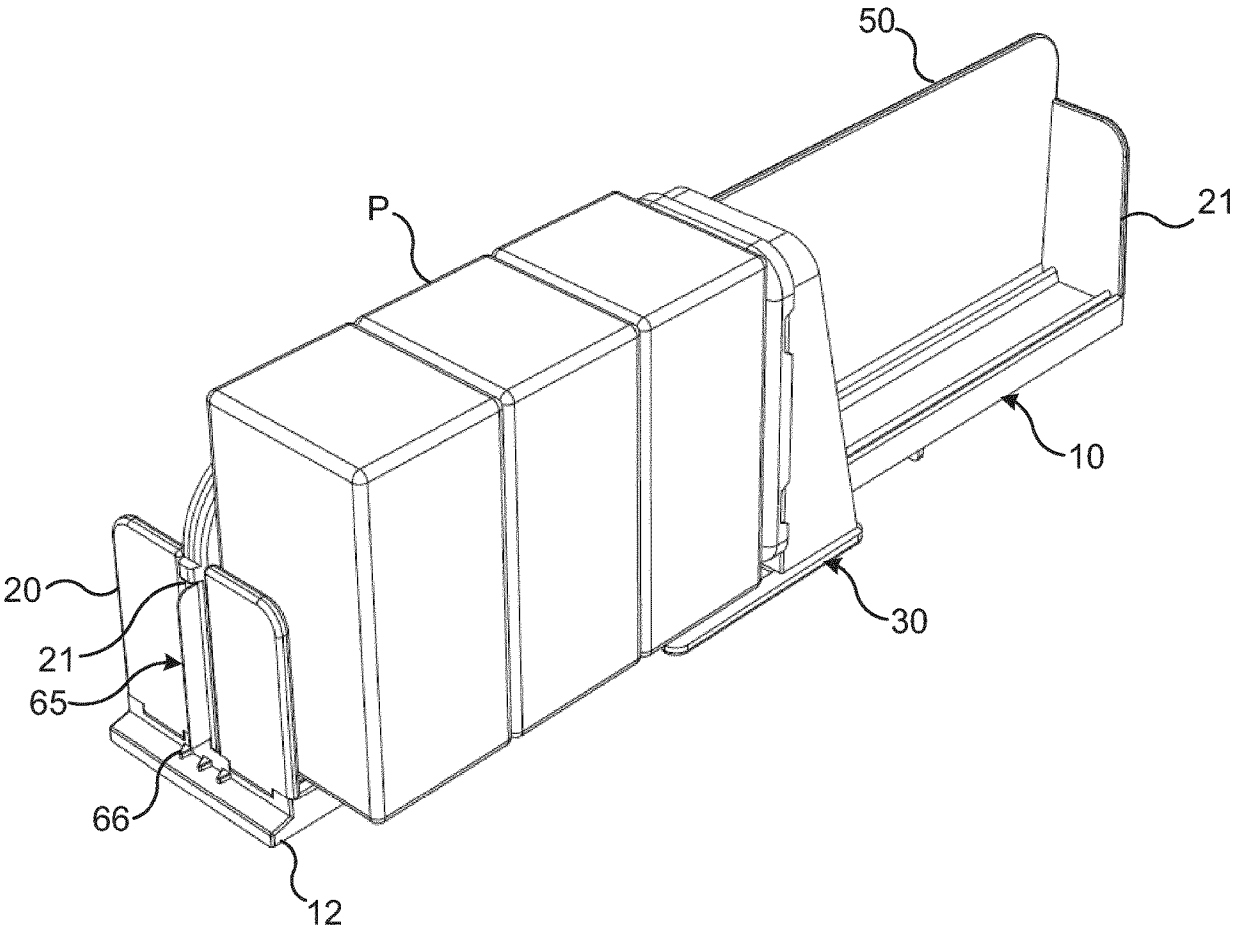
FIG. 1*b* is a similar view illustrating the device shown in FIG. 1*a* after removal of one of the products.
Figure 2:
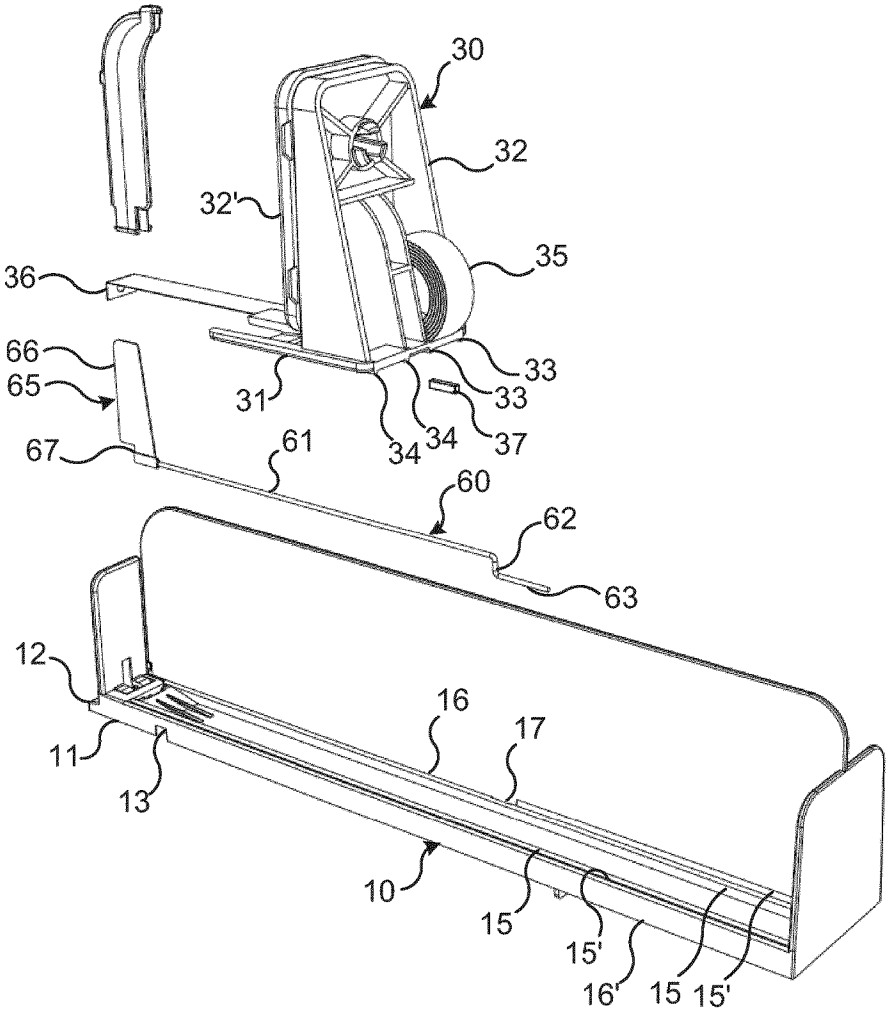
FIG. 2 is an exploded perspective view obliquely from behind of the device shown in FIGS. 1*a* and 1*b*, but without products.

The feeder device shown in FIGS. 1*a*-3*b* comprises a guide member 10, a sled 30 and a shelf divider wall or partition wall 50. In FIGS. 1*a* and 1*b*, a number of products P are shown inserted in the feeder device. In FIG. 3*a*, four products P are positioned on the guide member 10 and in FIG. 1*b* one product has been removed such that only three products P remain in the feeder device.

The guide member 10 is elongated and configured to be positioned on a shelf (not shown), such that it extends perpendicular to the front edge of the shelf. A front portion 11 of the guide member 10 comprises fixation means 12, 13 arranged to be engaged with a corresponding profiled front fixation device (not shown) arranged along the front edge of the shelf, as known in the art. When mounted to a shelf the front edge 12 of the guide member 10 thus extends in parallel with the front edge of the shelf and the guide member 10 extends towards the rear edge of the shelf.

In the embodiments shown in the drawings the divider wall 50 extends longitudinally along a centre line of the guide member 10. The divider wall 50 thus divides the feeder device and the guide member 10 in two halves extending longitudinally in parallel. In the illustrated embodiment, the feeder device comprises only one sled 30 being arranged at the left side half of the feeder device, as seen in the forward direction. The guide member 10 comprises a base portion 14 which on its upper side is provide with upwardly protruding and longitudinally extending guide rails 15. Each half of the guide member 10 is provided with two such guide rails 15. Each protruding guide rail 15 exhibits a longitudinal guide rail grove 15' for guiding the sled 30. The guide rails 15 also forms supports for products P being positioned in front of the sled 30 and functions to lower the friction between the products and the guide member when pushed forward by the sled 30.

The guide member 10 also comprises a front stop plate 20 and a back stop plate 21. The stop plates 20, 21 extend in parallel with each other and are arranged vertically and perpendicular to the longitudinal direction of the guide members 10 base portion 14. The front stop plate 20 prevents products P placed on the guide member 10 from being pushed forwardly passed the front end of the feeder device. The back stop plate 21 prevents the sled 30 to be pushed off the guide member 10 backwardly, when the sled 30 is manually pushed backwards for loading new products into the feeder device. A vertical slit 22 is formed in the front stop plate 20 for allowing a visual indicating flag 65 to pass through the front stop plate 21.

The sled 30 comprises a base 31 which is supported on the guide member 10 and a back support 32 which extends upwardly from the base 31. An extension plate 32' is pivotally connected to the back support. The extension plate may be rotated about an axis which is generally parallel with the longitudinal direction of the guide member 10. By this means the extension plate may be rotated such that it forms an extension of the back support either upwardly or in any sideways direction. The base 31 comprises on its lower side, two pairs of longitudinally extending and downwardly projecting guide ridges 33, 34. The guide ridges 33 of one pair are received in a respective guide rail groove 15' for guiding the sled 30 longitudinally along the guide member. The second pair of guide ridges 34 may be received in corresponding guide rail grooves (not shown) arranged at the right hand half of a second feeder device (not shown) being arranged side by side at the left hand side of the feeder device shown in the drawings. By such means the sled and the products P are fully supported by the left hand side of a first guide member 10 and the right hand side of a second guide member (not shown).

The sled 30 further comprises a coil spring 35 which is received in a recess of the back support 32. A portion of the coil spring 35 extends through an opening between the base 31 and the back support 32 and runs forwardly along the guide member 10, between the guide rails 15. An end portion 36 of the coil spring 35 is fixed to the front portion 11 of the guide member 10. By this means, the sled 30 is urged forwardly for displacement along the guide member by the spring force generated by the coil spring 35 as known in the art.

The feeder device further comprises means for indicating that the number of remaining products has decreased to a certain value. In the shown example these means are arranged to indicate that the number of products has fallen to three. In practice this is done by indicating that the sled 30 has reached a certain position along the guide member during forward movement.

The so called low stock indication means according to the illustrated example comprises a transmission member 60 and a flag 65. In the shown example the transmission member is formed as a rod 60 made of a magnetic material which in the shown example is steel. The rod 60 comprises a first rectilinear portion 61, a second portion 62 which extends perpendicular to the first portion 61 and a third portion 63 which extends perpendicular to the second portion 62 and in parallel with the first portion 61. The flag 65 is fixed to the free end of the first portion 61. The flag 65 comprises a front edge 66 and a lower stop edge 67 which is indented relative to the front edge 66. The first portion 61 of the rod 60 is received in a longitudinal groove 16 which is arranged in the guide member 10, between the divider wall 50 and the centre most guide rail 15. The second portion 62 extends through a through hole 17 arranged in the guide member 10. The through hole 17 is forwardly delimited by a front edge 17' and rearwardly delimited by a rear edge 17". The third portion 63 extends rearwardly at the lower side of the guide members 10 base portion 14.

The length of the first portion 61 of the rod 60 and the distance between the through holes 17 front edge 17' is greater that the accumulated thickness of three products P but lower than the accumulated thickness of four products P. The rod 60 is longitudinally displaceable relative to the guide member 10. Due to the fact that the second portion 62 of the rod 60 extends through the through hole 17 in the guide member 10, the displacement of the rod is limited to a distance which corresponds to the distance between the front edge 17' and the rear edge 17" of the through hole 17. During forward movement of the rod 60, the second portion 62 will make contact with the frond edge 17' thereby preventing further forward movement of the rod 60. Correspondingly, during backward movement of the rod 60, the second portion 62 will make contact with the rear edge 17", thereby preventing further backward movement of the rod 60. In the shown example the distance between the front 17' and rear 17" edges is approximately 10 mm. This distance thus constitutes the stroke of the rod 60 and is chosen in correspondence the width of the front edge 66 of the flag 65, which front edge gives the visual indication when it is time to refill the feeder device with new products, as will be explained more in detail below. By increasing the distance between the front 17' and rear 17" edges of the through hole it is thus possible to increase the stroke of the rod, thereby to make a larger portion of the flag indicating a low stock situation.

A magnet 37 is fixed to the lower side of the base 31 of the sled 30. The magnet 37 is positioned at the right hand edge of the base 31, as seen in the forward direction. By this means, the movement of magnet is aligned with the longitudinal extension of the rod 60.

Figure 3A:
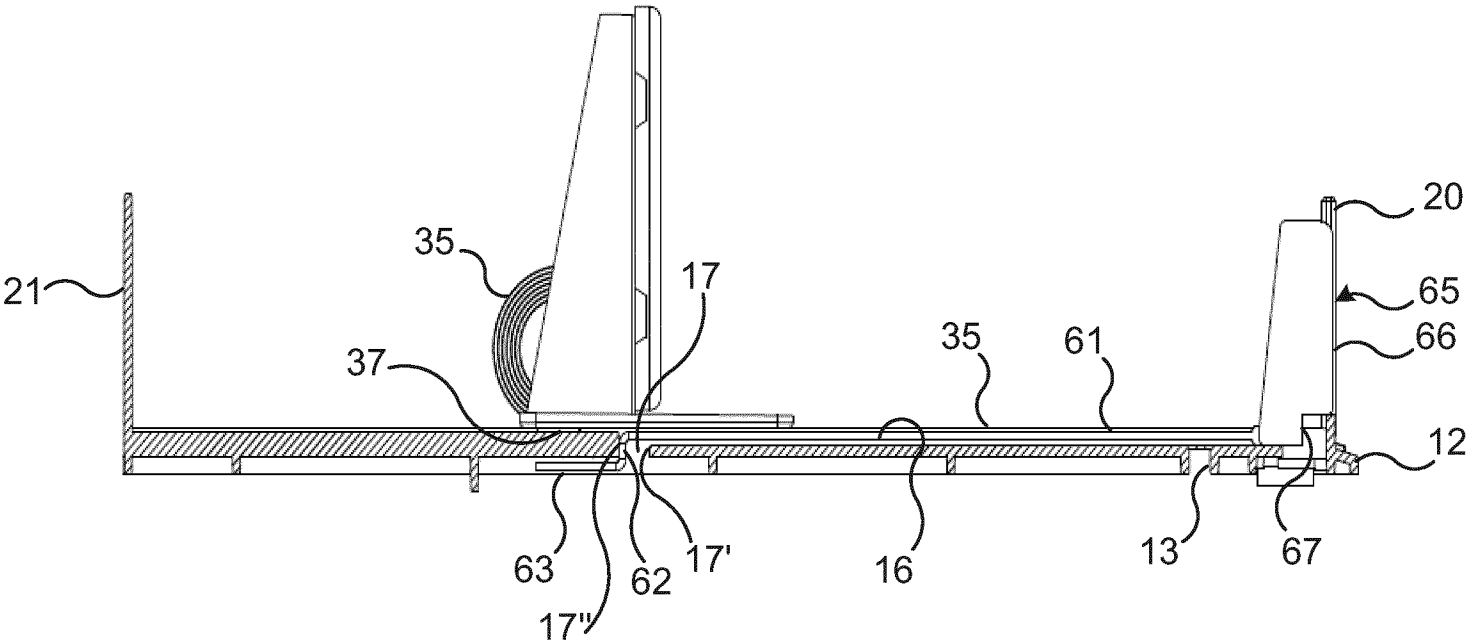
FIG. 3*a* is a longitudinal section through the device shown in FIGS. 1*a* and 1*b* without products, illustrating the low stock indicating means in a passive, non-indicating mode.

FIG. 3*a* illustrates the feeder device in a passive non-indicating mode. At this mode the sled 30 is positioned behind the position at which the feeder device should indicate a low stock situation. In the shown example the feeder device is arranged to indicate a low stock situation when the number of products has fallen below four. At this mode the rod 60 and the flag 64 are in a rearwardly retracted position. The second portion 62 of the rod 60 is positioned in contact with the rear edge 17" of the through hole 17 and the flag 65 is retracted such that the indicating front edge 66 does not protrude forwardly of the front stop plate 21. At this position of the rod 60 the sled 30 may move freely all the way from the backmost position (not shown), where the sled is positioned adjacent to the back stop plate 21, to the position shown in FIG. 3*a*. During such initial forward movement, the magnet 37 is at a distance from the magnetic rod 60 great enough such that the magnet does not influence the position of the rod 60. During this initial movement, the sled is thus displaced relative to the guide member 30 and the rod 60.

Figure 3B:
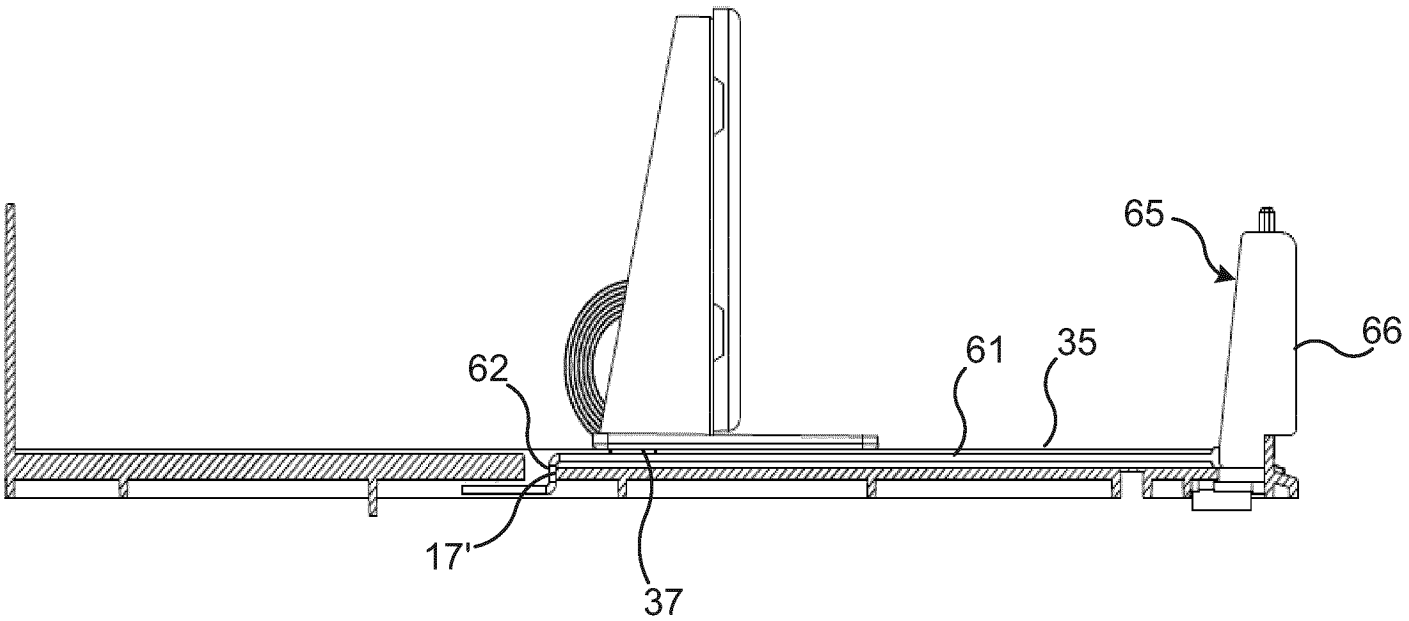
FIG. 3*b* is a view corresponding to FIG. 3*a* illustrating the low stock indicating means in an active indicating mode.

During continued forward movement from the position shown in FIG. 3*a* to the position shown in FIG. 3*b*, the magnet 37 will approach the second portion 62 of the rod 60 and will further come into a position where it overlaps the rear end of the first portion 61 of the rod 60. When the magnet 37 is overlapping the first portion 61 the distance between the magnet 37 and the first portion is small enough for allowing the magnetic interaction between the magnet 37 and the first portion 61 to pull the rod 60 along with the sled 30 during continued forward movement. During this simultaneous forward displacement of the sled 30 and the rod 60, the flag 65 is displaced forwardly such that the front edge 66 of the flag 65 protrudes forwardly through the slit 22 in the front stop plate 20, passed the front surface of the front stop plate 20. By this means the frond edge 66 of the flag 65 is clearly and readily seen by personnel walking along the front edge of the shelf. Preferably, the front edge of the flag is given a clear and bright colour which differs from the colour of other components of the shelf and from the products. By this means it is possible for personnel to not the low stitch situation merely by casting a glance along the aisle of shelves.

Once the rod 60 has been magnetically engaged with the sled 30 it will follow the sled forwardly along its stroke, until the rod reaches the position shown in FIG. 3*b*. At this position the second portion 62 contacts the front edge 17' of the through hole 17, whereby further forward displacement of the rod 60 is prevented. The front edge 66 of the flag has then been fully displaced to its outwardly and forwardly protruding and indicating position.

Upon picking of the remaining products from the feeder device, the sled 30 continues its forward displacement, urging the remaining products forwardly. At this instance however, the rod 60 and the flag 65 remain in the indicating position shown in FIG. 3*b*. During such forward movement of the sled 30, the magnet 37 is moved along the first portion 61 of the rod thereby maintaining the magnetic interaction between the sled 30 and the rod 60. By this means the magnetic force maintains the rod 60 and the flag 65 in the indicating positions and prevents them from being unintentionally returned to the passive non-indicating position.

When the feeder device is to be refilled with new products, the sled 30 is simply pushed manually all the way back to the back stop plate 21. During the initial backward movement of the sled 30 the magnetic interaction between the sled 30 and the rod 60 will force the rod 60 to follow the sled 30 backwards, until the second portion 62 of the rod again is brought into contact with the rear edge 17" of the through hole 17. Thereby the rod 60 and the flag 65 are returned to the passive non-indicating position as shown in FIG. 3*a*. During continued backward displacement of the sled 30, the distance between the magnet 37 and the rod 60 increases, such that the magnetic engagement is broken. When the sled 30 has been displace fully to the back, new products may be inserted between the back support 32 of the sled 30 and the front stop plate 20.

At an embodiment which is not shown in the drawings, the transmission member is also connected to an electronic switch which gives an electronic signal when the transmission member has assumed the active indicating position. Such a switch may e.g. be a micro switch which is arranged in proximity to the front edge of the through hole in the guide member, such that the micro switch is activated and transmits the signal when the second portion of the rod makes contact with the front edge of the through hole. The switch in turn may be connected to a control panel or a computer system, which gives a visual and/or audio signal when the switch is activated. The control panel or a computer display may e.g. be arranged remotely from the shelf, such as in an office of the shop. It is then possible for personnel working in the office to note that the feeder device should be refilled. Naturally there are many alternative ways to arrange that an electronic signal is generated when the transmission member has reached its active indicating position. Other types of sensors for sensing the position of the transmission member may be utilized. In a simple form, a metallic part of the transmission member, such as the second portion of the rod shown in the drawings, may be arranged to electrically close a circuit when the rod is in the frontmost position. The generated signal may be conducted to a control panel or a computer by wires or it may be wirelessly transmitted. Especially at shelf management systems comprising a plurality of low stock indicating feeder devices, the signal should preferably also comprise identification information such that it is possible to detect which feeder device is running out of products.

When applied, such electronic indication means is preferably combined with the above described visual indication means. It is however also possible that the feeder device comprises indication means only for electronic indication.

The present disclosure has mainly been described above with reference to a few embodiments. However, as is readily appreciated by a person skilled in the art, other embodiments than the ones disclosed above are equally possible within the scope of the present disclosure, as defined by the appended patent claims. For example, the magnet may be fixed to the transmission member instead of being fixed to the sled. At such instances the sled should comprise a magnetic material for allowing a magnetic interaction between the sled and the transmission member. It is also possible that both the sled and the transmission member comprises a respective magnet which magnets then are oriented to attract each other.

The transmission member may also be formed differently than shown in the drawings. It may e.g. comprise one single rectilinear metallic rod with a transversely protruding organ, such as a peg which is received in a through hole or between other opposed stop surfaces of the guide member, for limiting the movement of the transmission member relative to the guide member. Alternatively, the transmission member may be formed generally out of polymer material and may have many different shapes and configurations. The transmission member should then comprise a magnet or a magnetic material which is capable to interact magnetically with a corresponding magnetic material or a magnet arranged at the sled.

The guide member and the sled may take many different forms and the sled may be urged forwardly by other means than a coil spring. For example, the guide member may be formed as an elongate tray in which the sled is longitudinally movable. The sled may be urged forwardly by a compression spring arranged between the back of the guide member and the sled or by a tension spring arranged between the front of the guide member and the sled. Alternatively, the feeder device may be a manually operated feeder wherein the sled is moved forwardly manually by gripping and pulling a handle being connected to the sled. The feeder device may by a so called two track device as shown in the drawings however it may also be a single track feeder or it may contain any desirable number of tracks for support of respective rows of products. The feeder device may comprise one or several divider walls or it may be designed without any shelf dividing means.

The invention claimed is:

1. A feeder device configured for mounting on a shelf for feeding successive products to a front of the shelf, the device comprising:
   - an elongated guide member which is configured for extending longitudinally backwards from the front of the shelf when the device is mounted;
   - a sled slidably arranged at the guide member such that the sled can slide along the length of the elongated guide member, configured for engaging a backmost product of the successive products for pushing the products towards the front of the shelf;
   - means for urging the sled along the guide member towards a front end of said guide member; and
   - indication means arranged to indicate that the sled has reached a certain position along the guide member;
   - characterised in that
     - the indication means comprises (i) a transmission member which is longitudinally, limitedly displaceable relative to the guide member; and (ii) a magnet which is arranged to connect and to disconnect the transmission member with and from the sled.

2. A feeder device according to claim 1, wherein the indication means comprises a visual indicator which is arranged at the front end of the guide member.

3. A feeder device according to claim 2, wherein the visual indicator is connected to the transmission member.

4. A feeder device according to claim 1, wherein the indication means comprises an electronic circuit arranged to give an electronic indication when the sled has reached said certain position along the guide member.

5. A feeder device according to claim 4, wherein the electronic circuit is arranged to give the electronic indication at a distance from the shelf.

6. A feeder device according to claim 1, wherein one of the sled and the transmission member comprises a first magnet and the other of the sled and the transmission member comprises a second magnet or a magnetic material, and wherein the second magnet or the magnetic material respectively is arranged to be attracted by the first magnet, thereby connecting the transmission member with the sled.

7. A feeder device according to claim 1, wherein the transmission member comprises a metal rod.

8. A feeder device according to claim 1 wherein the transmission member is guidedly received in a longitudinal groove arranged in the guide member.

9. A feeder device according to claim 1, wherein the transmission member and the guide member are provided with cooperating stop means arranged to allow only a limited longitudinal displacement of the transmission member relative to the guide member.

10. A feeder device according to claim 1, wherein the guide member exhibits a through hole with a front edge and a rear edge and the transmission member comprises a stop portion extending through the through hole and being arranged to limit forward and rearward displacement of the transmission member by contacting the front edge and rear edge respectively.

11. A feeder device according to claim 10, wherein the transmission member is guidedly received in a longitudinal groove arranged in the guide member and wherein the through hole is arranged in a bottom surface of the longitudinal groove.

12. A feeder device according to claim 7, wherein the transmission member is formed of a magnetic metal rod exhibiting a first rectilinear front portion a second intermediate stop portion which extends perpendicularly from the first portion and a third rectilinear rear portion which extends perpendicular from the second portion and in parallel with the first portion.

13. A feeder device according to claim 12, wherein the first portion is guidedely received in a longitudinal groove arranged in the guide member, the second portion extends through a through hole arranged in the guide member and the third portion is arranged below a bottom wall of the guide member.

14. A feeder device according to claim 1, wherein the means for urging the sled forwardly comprises a coil spring with an end portion which is fixed to the front end of the guide member.

15. A feeder device according to claim 1, wherein the guide member comprises a shelf divider wall.

* * * * *